US005150592A

United States Patent [19]

Lin

[11] Patent Number: 5,150,592

[45] Date of Patent: Sep. 29, 1992

[54] LOCKING DEVICE FOR AN AUXILIARY LOCK

[75] Inventor: Jui C. Lin, Kaohsiung Hsien, Taiwan

[73] Assignee: Taiwan Fu Hsing Industry Co., Ltd., Kaohsiung, Taiwan

[21] Appl. No.: 800,979

[22] Filed: Dec. 2, 1991

[51] Int. Cl.[5] ..... E05B 9/04

[52] U.S. Cl. ..... 70/190; 70/218; 70/224; 70/379 R; 70/381; 70/386; 70/422; 70/472; 74/527; 74/528; 74/529; 292/252; 292/336.3

[58] Field of Search ..... 70/284, 285, 379 R, 70/379 A, 380, 381, 190, 191, 224, 472, 149, 386, 218, 422; 74/527, 528, 529; 292/252, 336.3

[56] References Cited

U.S. PATENT DOCUMENTS

| | | | |
|---|---|---|---|
| 1,859,130 | 5/1932 | Dant | 70/379 R |
| 2,095,100 | 10/1937 | Maillard | 74/528 |
| 3,464,243 | 9/1969 | Hawkins | 70/422 |
| 4,679,420 | 7/1987 | Yang | 70/422 |
| 4,941,697 | 7/1990 | Fan | 292/DIG. 27 X |
| 5,010,749 | 4/1991 | Lin | 70/190 |
| 5,040,652 | 8/1991 | Fish et al. | 70/422 X |

FOREIGN PATENT DOCUMENTS

| | | | |
|---|---|---|---|
| 3238660 | 4/1984 | Fed. Rep. of Germany | 74/527 |

*Primary Examiner*—Lloyd A. Gall

*Attorney, Agent, or Firm*—Fleit, Jacobson, Cohn, Price, Holman & Stern

[57] ABSTRACT

A locking device for an auxiliary lock comprising a rotatable ring provided with inner teeth around the inner peripheral surface and a traditional lock additionally provided with a lateral hole to fit a spring and a steel ball pushed by the spring therein, the ball extending a little out of the lateral hole to engage with the inner teeth in the rotatable ring, the inner teeth being able to be felt surely to slide over the ball when the rotatable ring is rotated.

1 Claim, 3 Drawing Sheets

LOCKING DEVICE FOR AN AUXILIARY LOCK

BACKGROUND OF THE INVENTION

There is a locking device for an auxiliary lock of U.S. Pat. No. 5,010,749, which comprises a rotatable ring and a base. The ring is fitted around the auxiliary lock and combined with the base. Then they are mounted in the door to let a large part of the rotating ring be exposed outside the door, and rotating the ring can cause the dead bolt of the auxiliary lock to extend out locking the door.

When the rotatable ring in said lock is rotated, it does not bump against anything, so a person who turns it may have a wrong feeling that the lock is not locked. So this invention has been devised to improve its structure which gives a user a feeling of bumping movement and clicking sounds when the rotatable ring is rotated so as to make it clear that this lock has been locked.

SUMMARY OF THE INVENTION

The locking device for an auxiliary lock in the present invention comprises a lock, a rotatable ring, a base, and an actuating wheel combined together.

The lock is additionally provided with a lateral hole for fitting a spring and a steel ball, and the ball is kept in contact with two adjacent teeth of a toothed ring fixed around the inner peripheral surface of the rotatable ring so that when the rotatable ring is rotated, the two adjacent teeth coming to contact the ball can give out a little bumping sound and feeling, which can give a person turning the rotatable ring a definite feeling of turning it.

DETAILED DESCRIPTION OF THE INVENTION

Figure 1:
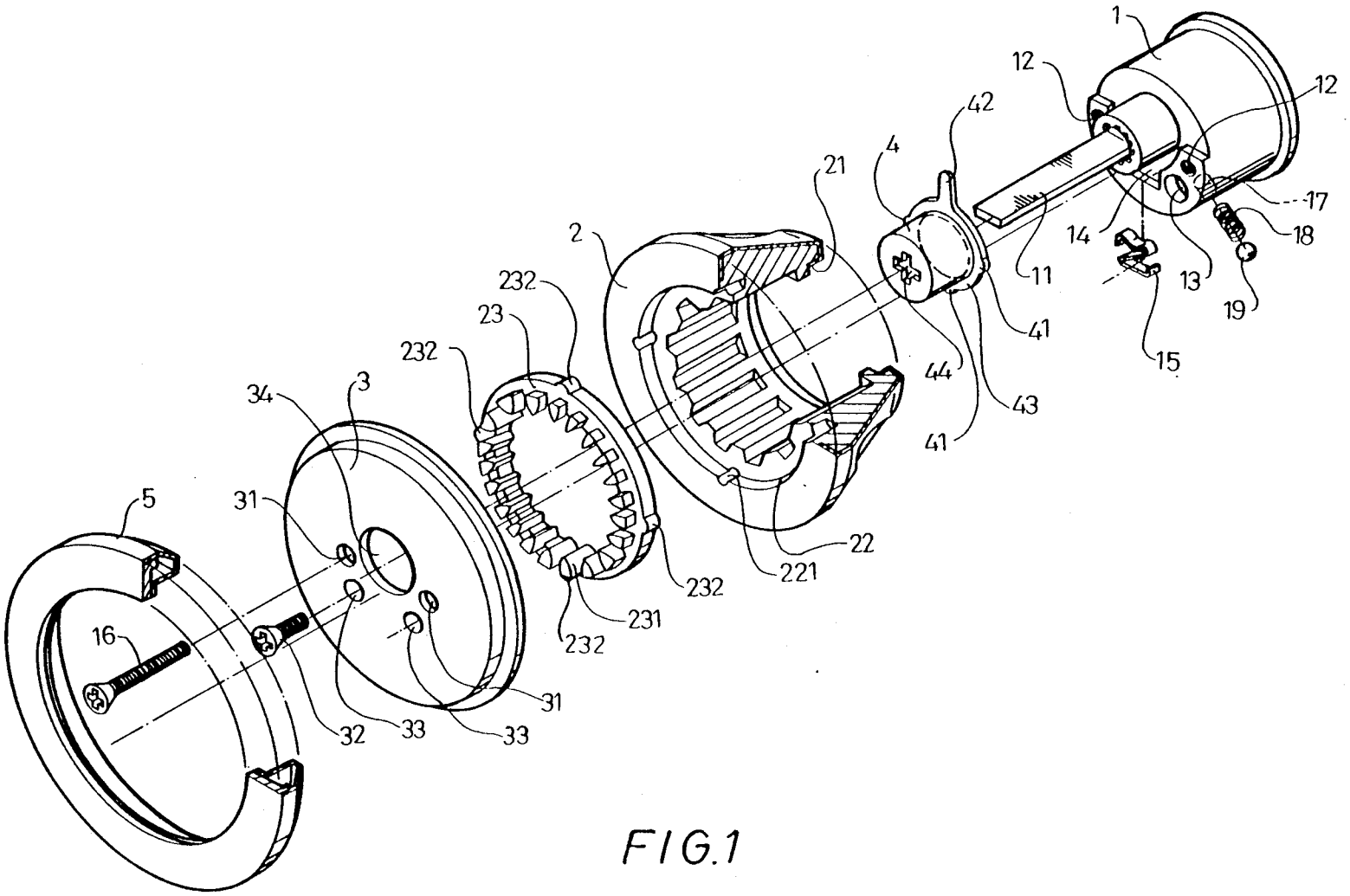
FIG. 1 is an exploded perspective view of the locking device for an auxiliary lock in the present invention.

The locking device for an auxiliary lock in the present invention, as shown in FIG. 1, comprises a rotatable ring 2, a base 3, an actuating wheel 4 to be combined with a key cylinder lock 1. The actuating plate 11 of the lock 1 goes through the dead bolt (not drawn out in the FIGS.) and the lock 1 is provided with holes 12 for screws 16 to pass through from the inside of a door through holes 31 in the base 3 so that said screws can fix this locking device with the lock 1 together on a door.

The lock 1 is also provided with screw holes 13 for screws 32 to pass through to screw in holes 33 in the base 3 to combine the base 3 with the lock 1 so that the lock 1 cannot be illegally broken and taken off after mounted in a door. The lock 1 also has a recessed opening 14 for a bent plate spring 15 to fit therein, and the spring 15 has a middle recess in the top for one of three small teeth in the actuating wheel 4 to engage and stop therein. The lock also has a lateral hole 17 for fitting a spring 18 and a steel ball 19 pushed by the spring 18 to extend a little out of the hole 17 so as to stick to any two adjacent teeth 231 of a toothed ring 23 so that when the toothed ring is rotated, the ball 19 can be felt to slide over the teeth 231.

The rotatable ring 2 has a peripheral lip at the right end for the flange of the lock 1 to fit therein to combine the ring 2 with the lock 1, and a large inner hole 22 at the left end provided with grooves 221 for projections 232 on the peripheral outer surface of the toothed ring 23 to fit therein so that the rotatable ring 2 and the toothed ring 23 can rotate all together.

The toothed ring 23 is provided with teeth 231 around its inner peripheral surface for a long tooth 42 in the actuating wheel 4 to engage with or separate from, and for the ball 19 engage with to as well.

The base 3 has holes 33 for screws 32 to pass through combining the base 3 with the lock 1, two holes 31 for screws 16 to pass through to assemble the base 3 and the rotatable ring 2 and the lock 1 together on a door from the inside of the door. The base 3 also has a round opening 34 for the actuating wheel 4 to fit and rotate therein.

The actuating wheel 4 fits and rotates in the opening 34 in the base 3, having a larger diameter flange 43, a long tooth 42 and three small teeth spaced apart 90° on the flange 43. The long tooth 42 can engage with one of the teeth 231 in the toothed ring 23, but the actuating wheel 4 and the rotatable ring 2 rotate on different axes so that the rotatable ring 2 can only rotate the actuating wheel 4 less than 90° and the tooth 42 separates from one of the teeth 231 when the ring 2 rotates more than 90°. In order to make the actuating wheel 4 to rotate 90° and to stabilize said wheel 4 when its rotates 90°, three small teeth 41 spaced apart 90° are provided on the flange 43. So when the actuating wheel 4 rotates nearly 90°, one of the small teeth 41 fits in the middle recess in the bent plate spring 15 so that said wheel 4 can be pushed to the 90° point and stops there. The actuating wheel 4 also has a cross hole 44 in the vertical side for the actuating plate 11 to pass through for mutual movement to rotate 90°.

A face ring 5 is additionally provided in this invention to cover the base 3 for adornment after the base 3, the rotatable ring 2 and the lock 1 are assembled together.

Figure 3:
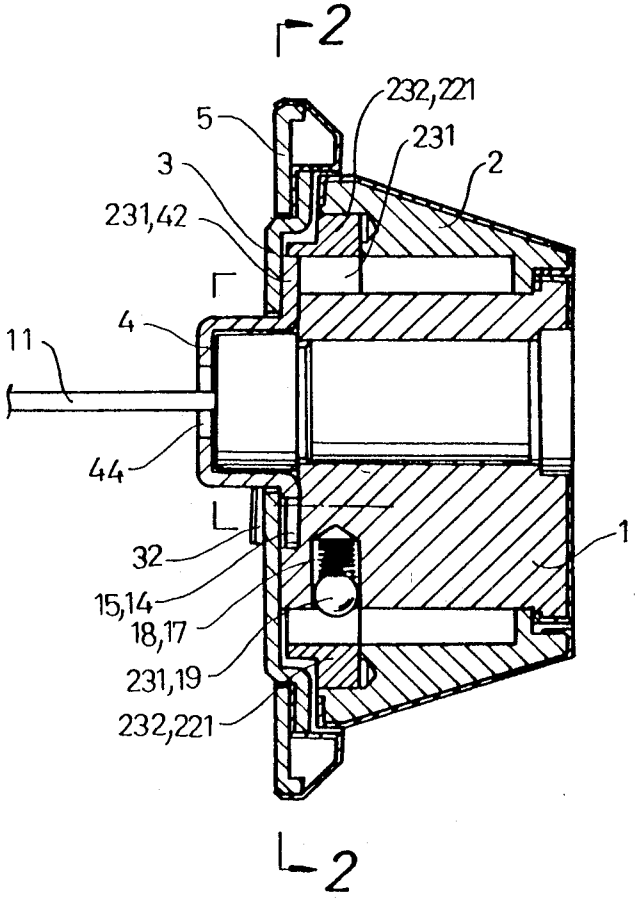
FIG. 3 is a side cross-sectional view of the locking device for an auxiliary lock in the present invention.
Figure 2:
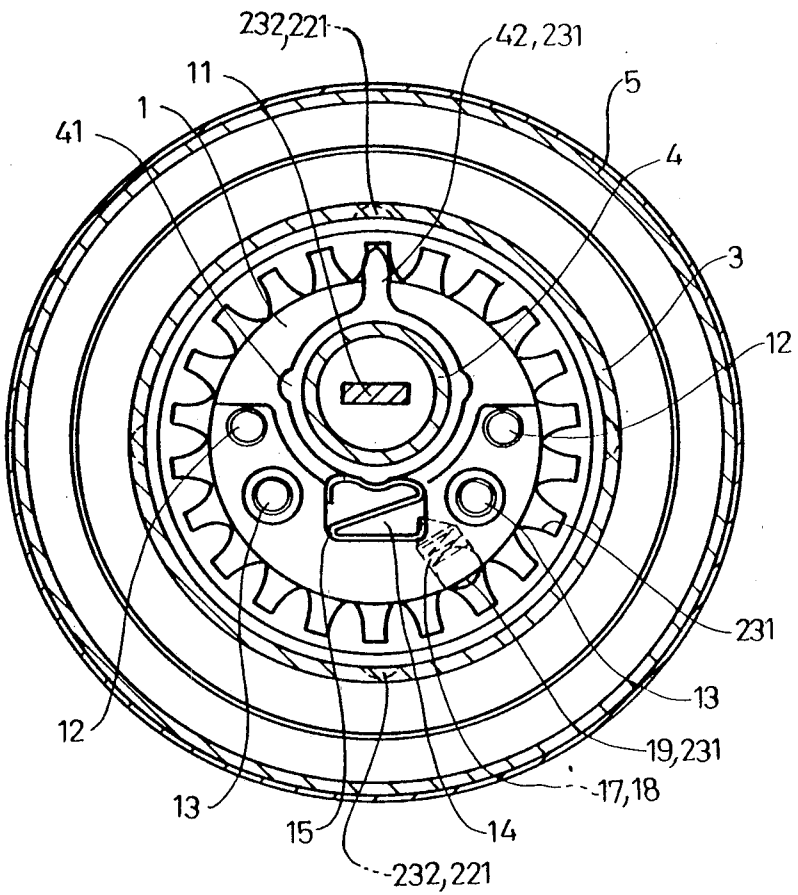
FIG. 2 is a cross-sectional view of 2–2 line in FIG. 3.
Figure 5:
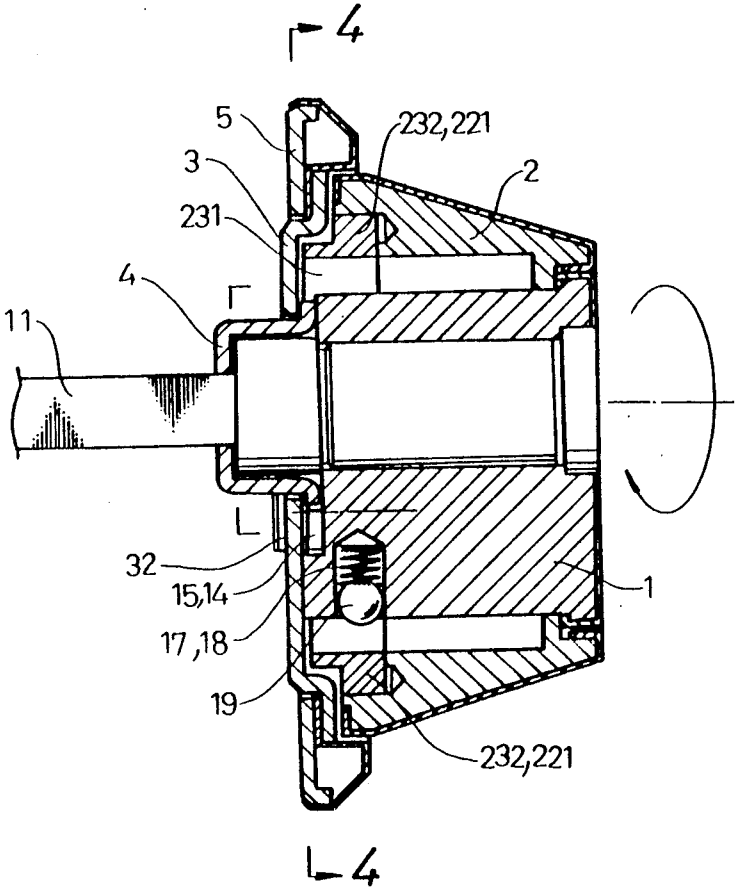
FIG. 5 is a cross-sectional view of the rotatable ring in FIG. 3 rotated for 90°.
Figure 4:
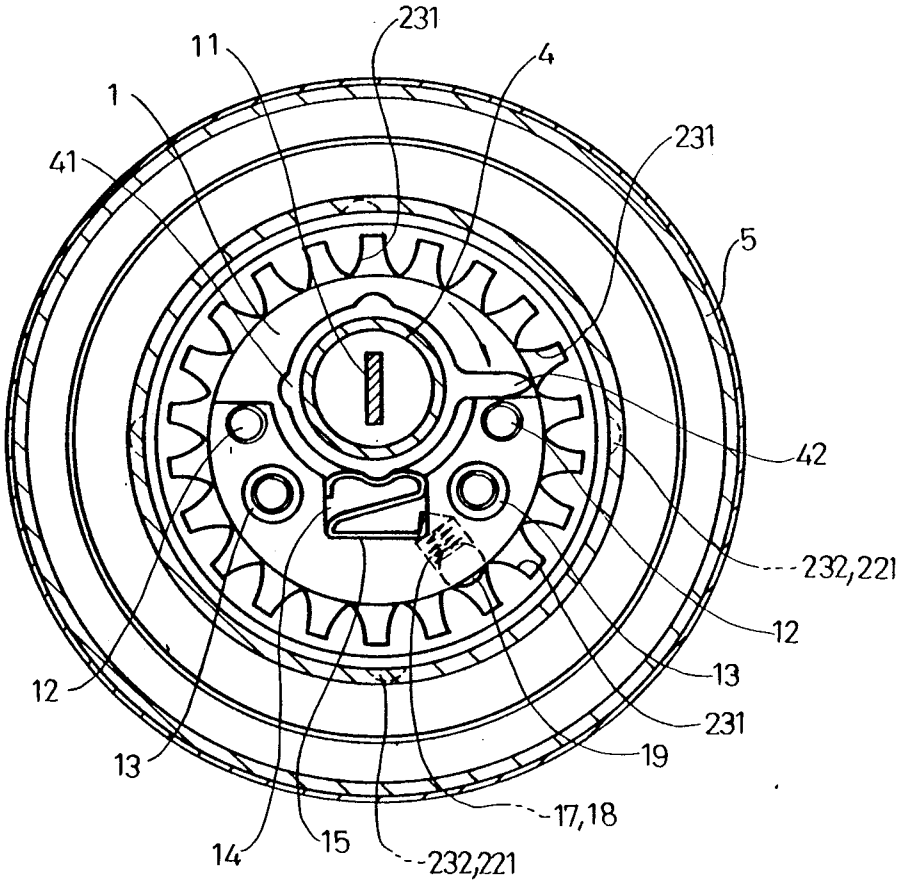
FIG. 4 is a cross-sectional view of 4–4 line in FIG. 5.

FIGS. 2, 3 show this locking device in unlocked condition, and the actuating plate 11 is lying horizontal, the plate spring 15 has its middle recess engaging with one of the small teeth 41, and the long tooth 42 in the actuating wheel 4 is engaging with one of the teeth 231 in the toothed ring 23. The lock 1 under this condition can be locked from the outside of the door without a correct key, by rotating the rotatable ring 2 90° forcing the teeth 231 of the toothed ring 23 to move the tooth 42 in the actuating wheel 4. Then, when said wheel 4 is rotated to 90°, one of the small teeth 41 can slide into the middle recess in the plate spring 15 and stop stabilized there, as shown in FIG. 4. The tooth 231 then separates from the tooth 42. However, the teeth 231 in the toothed ring 23 have to slide over the ball 19 during rotation of the rotatable ring 2, and so its sliding movement is surely to be felt by the fingers of a user, and little bumping sounds of the ball 19 and the teeth 231 can be heard as well.

What is claimed is:

1. A locking device comprising a key cylinder lock, a rotatable ring, a base and an actuating wheel combined together, said lock being additionally provided with a lateral hole for fitting therein a spring and a steel ball elastically pushed by the spring to extend out of the lateral hole a little and to engage with side faces of two adjacent teeth around to toothed ring provided in an inner peripheral surface of the rotatable ring, said toothed ring and the rotatable ring being able to rotate together.

* * * * *